US009061495B2

(12) United States Patent
Nakamura

(10) Patent No.: US 9,061,495 B2
(45) Date of Patent: Jun. 23, 2015

(54) INKJET PRINTER

(71) Applicant: RISO KAGAKU CORPORATION, Tokyo (JP)

(72) Inventor: Hiroyuki Nakamura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 13/922,560

(22) Filed: Jun. 20, 2013

(65) Prior Publication Data

US 2013/0342599 A1 Dec. 26, 2013

(30) Foreign Application Priority Data

Jun. 26, 2012 (JP) ..... 2012-142756

(51) Int. Cl.
*B41J 2/155* (2006.01)
*B41J 2/07* (2006.01)
*B41J 2/21* (2006.01)

(52) U.S. Cl.
CPC . *B41J 2/07* (2013.01); *B41J 2/2146* (2013.01)

(58) Field of Classification Search
CPC ..... B41J 2/2146
USPC ..... 347/42
See application file for complete search history.

(56) References Cited

U.S. PATENT DOCUMENTS 6,578,950 B2 * 6/2003 Matsumoto et al. ..... 347/42

FOREIGN PATENT DOCUMENTS

JP 2011-143712 A 7/2011

* cited by examiner

*Primary Examiner* — Julian Huffman
(74) *Attorney, Agent, or Firm* — Greenblum & Bernstein P.L.C.

(57) ABSTRACT

A controller is configured to determine nozzles to be used for ejection in nozzle arrays in a upstream head block by selecting endmost nozzles from nozzles in a region of the upstream head block overlapping a downstream head block so that the endmost nozzle of the nozzle array located more downstream is closer to a center of the upstream head block, and determine nozzles to be used for ejection in nozzle arrays in the downstream head block by selecting endmost nozzles from nozzles in a region of the downstream head block overlapping the upstream head block so that the endmost nozzle of the nozzle array located more upstream is closer to a center of the downstream head block.

1 Claim, 7 Drawing Sheets

INKJET PRINTER

CROSS REFERENCE TO RELATED APPLICATION

This application is based upon and claims the benefit of priority from the prior Japanese Patent Application No. 2012-142756, filed on Jun. 26, 2012, the entire contents of which are incorporated herein by reference.

BACKGROUND

1. Technical Field

The present invention relates to an inkjet printer configured to print on a print medium through ejection of ink from an inkjet head.

2. Related Art

Japanese Patent Application Publication No. 2011-143712 proposes an inkjet printer having a line inkjet head formed by multiple head blocks.

Some of such inkjet heads are known to have multiple head blocks arranged in a zigzag manner. More specifically, in such an inkjet head, multiple head blocks are arranged in a direction (a main-scanning direction) substantially orthogonal to a conveyance direction of a sheet (a sub-scanning direction) while being alternately displaced in position in the sub-scanning direction. In order to prevent a joint portion of the head blocks from causing a white line or the like in a printed image, the head blocks are arranged in the main scanning direction in such a manner that adjacent ones partially overlap each other. Then, in a portion where adjacent head block overlap each other, nozzles used for ink ejection are determined for each head block so that ink will not be ejected from the two adjacent head blocks to the same position during printing.

SUMMARY

To aim, for example, reduction in man-hours for attaching the head blocks, some inkjet color printers use head blocks each having multiple nozzle arrays capable of ejecting inks of different colors from one another. In some of such head blocks, the nozzles of adjacent nozzle arrays are displaced in position from each other in the main scanning direction.

An inkjet head having zigzag-arranged head blocks as described above forms each line in an image to be printed, by ejecting inks of multiple colors sequentially from the upstream head blocks, and then ejecting inks of multiple colors sequentially from the downstream head blocks. Thereby, a printed image of a secondary color is formed by the inks of multiple colors superimposed on one another.

In the case where the nozzles of adjacent nozzle arrays in a head block are displaced in position from each other in the main scanning direction, inks of respective colors are sometimes superimposed on one another by an overlapping portion of the head blocks in an order different from that at the other portion, depending on which nozzles of each nozzle array are selected to be used for ink ejection. As a result, a portion having a different color tone from its surrounding portion may be formed in a printed image, which lowers the quality of a printed image.

The present invention aims to provide an inkjet printer capable of suppressing lowering of the quality of a printed image.

An inkjet printer in accordance with some embodiments includes an inkjet head having a first head block and a second head block and configured to eject ink to a print medium being conveyed in a conveyance direction, and a controller configured to control the inkjet head. The second head block is arranged downstream of the first head block in a first direction being the conveyance direction, in a manner that the second head block is displaced from the first head block to partially overlap the first head block in a second direction orthogonal to the first direction. Each of the first head block and the second head block includes a plurality of nozzle arrays arranged side by side in the first direction and each having a plurality of nozzles arranged in the second direction. In each of the first head block and the second head block, the nozzle arrays are arranged with the nozzles of the adjacent nozzle arrays displaced in position from each other in the second direction. In each of the first head block and the second head block, the plurality of nozzle arrays is configured to eject inks of different colors respectively. The first head block and the second head block have a same arrangement of colors in the plurality of nozzle arrays. The controller is configured to determine nozzles to be used for ejection in the nozzle arrays in the first head block by selecting endmost nozzles from nozzles in a region of the first head block overlapping the second head block so that the endmost nozzle of the nozzle array located more downstream in the first direction is closer to a center of the first head block in the second direction. The controller is configured to determine nozzles to be used for ejection in the nozzle arrays in the second head block by selecting endmost nozzles from nozzles in a region of the second head block overlapping the first head block so that the endmost nozzle of the nozzle array located more upstream in the first direction is closer to a center of the second head block in the second direction.

According to the above configuration, the controller determines nozzles to be used for ejection in the nozzle arrays in the first head block by selecting endmost nozzles in an overlapping region between the first head block and the second head block so that the endmost nozzle of the nozzle array located more downstream in the first direction is closer to a center of the first head block in the second direction, and the controller determines nozzles to be used for ejection in the nozzle arrays in the second head block by selecting endmost nozzles in the overlapping region between the first head block and the second head block so that the endmost nozzle of the nozzle array located more upstream in the first direction is closer to a center of the first head block in the second direction. Thereby, in the entire region where the first head block and the second head block overlap each other, inks of respective colors are superimposed in the same order as in a portion outside the overlapping region. As a result, lowering of the quality of a printed image can be suppressed.

An inkjet printer in accordance with some embodiments includes an inkjet head having a first head block and a second head block and configured to eject ink to a print medium while reciprocating in a first direction above the print medium, a driver configured to reciprocate the inkjet head in the first direction during printing, and a controller configured to control the inkjet head and the driver. The second head block is displaced from the first head block to partially overlap the first head block in a second direction orthogonal to the first direction. Each of the first head block and the second head block includes a plurality of nozzle arrays arranged side by side in the first direction and each having a plurality of nozzles arranged in the second direction. In each of the first head block and the second head block, the nozzle arrays are arranged with the nozzles of the adjacent nozzle arrays displaced in position from each other in the second direction. In each of the first head block and the second head block, the plurality of nozzle arrays is configured to eject inks of different colors respectively. The first head block and the second head block have a same arrangement of colors in the plurality of nozzle arrays. In printing, the controller is configured to determine nozzles to be used for ejection in the nozzle arrays in a front one of the first and second head blocks located frontward of the other one in a moving direction of the inkjet head, by selecting endmost nozzles from nozzles in a region of the front head block overlapping the other head block so that the endmost nozzle of the nozzle array located more rearward in the moving direction is closer to a center of the front head block in the second direction. In printing, the controller is configured to determine nozzles to be used for ejection in the nozzle arrays in a rear one of the first and second head blocks located rearward of the other one in the moving direction of the inkjet head, by selecting endmost nozzles from nozzles in a region of the rear head block overlapping the other head block so that the endmost nozzle of the nozzle array located more frontward in the moving direction is closer to a center of the rear head block in the second direction.

According to the above configuration, in printing, the controller determines nozzles to be used for ejection in the nozzle arrays in a front one of the first and second head blocks which is located frontward of the other one in a moving direction of the head blocks, by selecting endmost nozzles in an overlapping region between the front head block and the other head block so that the endmost nozzle of the nozzle array located more rearward in the moving direction is closer to a center of the front head block in the second direction, and the controller determines nozzles to be used for ejection in the nozzle arrays in a rear one of the first and second head blocks which is located rearward of the other one in the moving direction of the head blocks, by selecting endmost nozzles in an overlapping region between the rear head block and the other head block so that the endmost nozzle of the nozzle array located more frontward in the moving direction is closer to a center of the rear head block in the second direction. Thereby, in an entire region where the first head block and the second head block overlap each other, inks of respective colors are superimposed in the same order as in a portion outside the overlapping region. As a result, lowering of the quality of a printed image can be suppressed.

DETAILED DESCRIPTION

Figure 1:
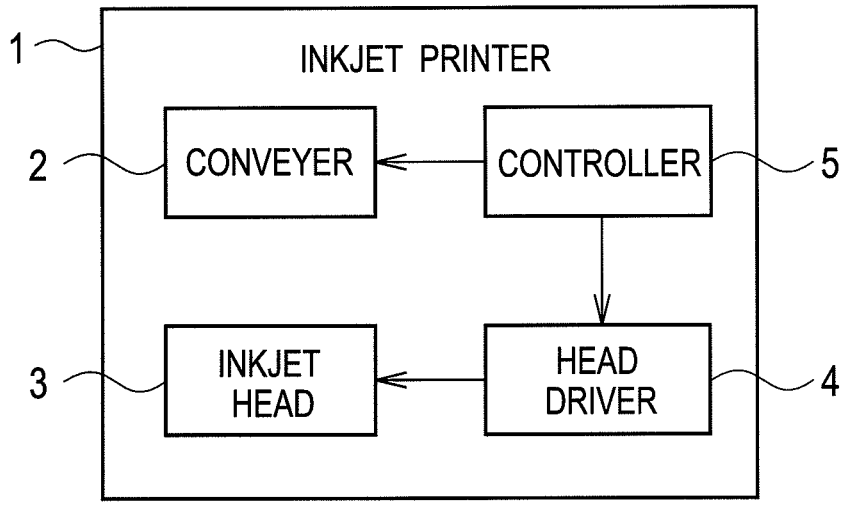
FIG. 1 is a block diagram showing the configuration of an inkjet printer according to an embodiment.

With reference to the drawings, an embodiment of the present invention is described below. Throughout the drawings, the same or like portions or elements are denoted by the same or like reference numerals. In addition, it should be noted that the drawings are only schematic and ratios of dimensions and the like are different from actual ones. Moreover, the drawings naturally include portions having different dimensional relationships and ratios from each other.

The embodiment is given below only to provide an example of a machine and the like for embodying a technical concept of the present invention, and the technical concept of the present invention does not limit the arrangement of elements and the like to what is described below. The technical concept of the present invention can be variously changed without departing from the scope of claims.

Figure 2:
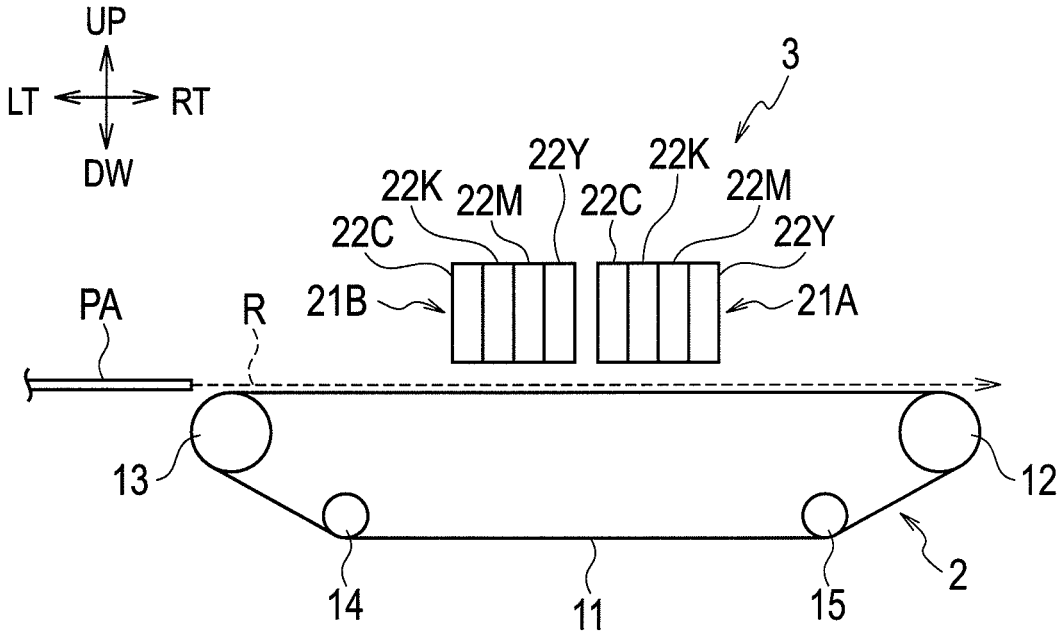
FIG. 2 is a diagram schematically showing the configuration of a conveyer and an inkjet head.
Figure 3:
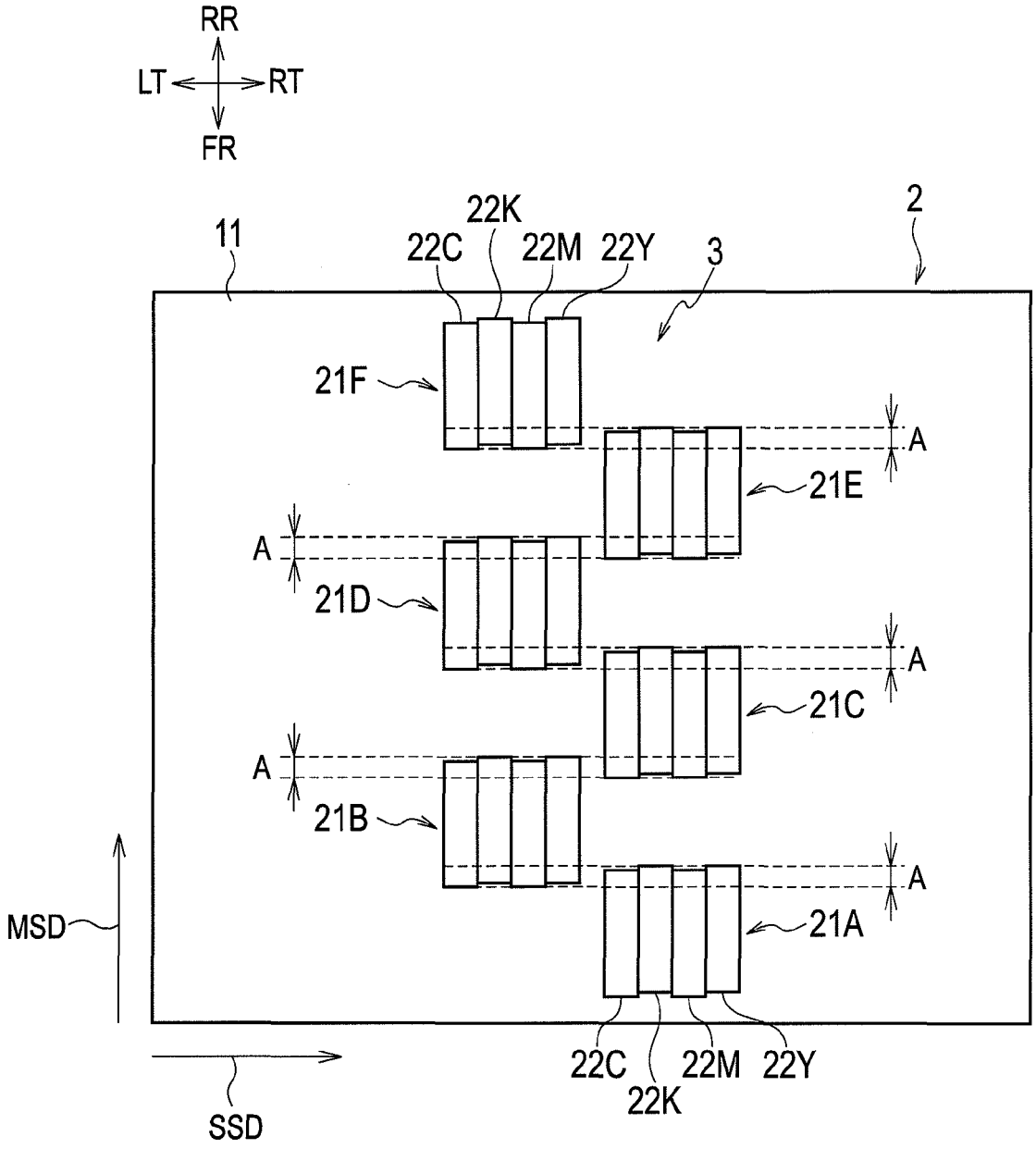
FIG. 3 is a plan view of the conveyer and the inkjet head.
Figure 4:
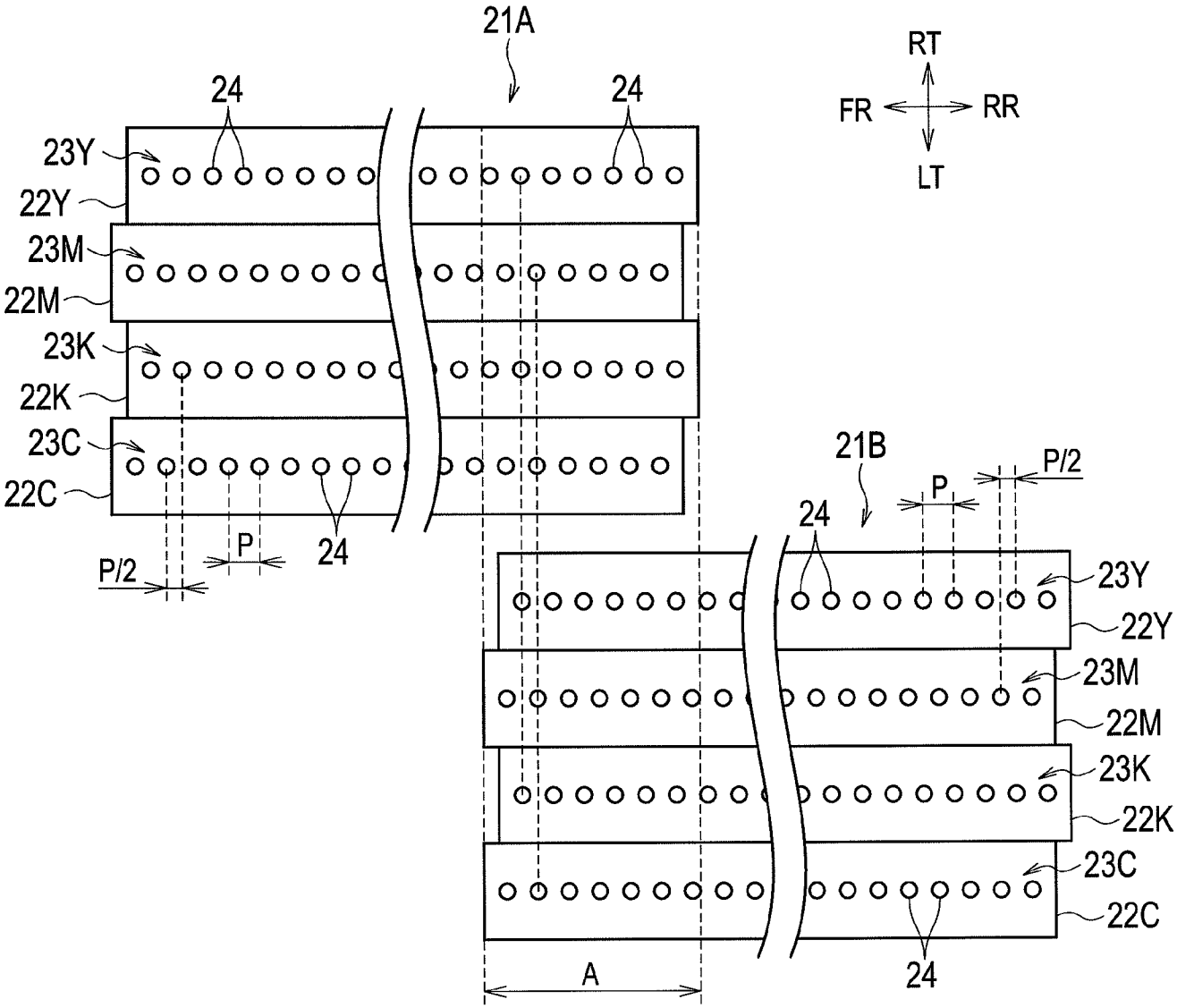
FIG. 4 is a diagram schematically showing a head block.

FIG. 1 is a block diagram showing the configuration of an inkjet printer according to the embodiment of the present invention. FIG. 2 is a diagram schematically showing the configuration of a conveyer and an inkjet head of the inkjet printer shown in FIG. 1. FIG. 3 is a plan view of the conveyer and the inkjet head. FIG. 4 is a diagram schematically showing head blocks.

In the following description, a direction orthogonal to the plane of FIG. 2 is a front direction and a rear direction, where a direction from the front side of the plane is a front. Further, as shown in FIG. 2, up, down, left, and right seen from the front is an up direction, a down direction, a left direction, and a right direction, and they are denoted in the drawings as UP, DW, LT, and RT, respectively. The front direction and the rear direction are orthogonal to the up, down, left, and right directions as shown in FIG. 3 and so on, and denoted in the drawings as FR and RR, respectively. A path shown in FIG. 2 with a broken line is a conveyance path R along which a sheet PA as a print medium is conveyed, and its conveyance direction is from the left to the right. In the following description, upstream and downstream mean those in the conveyance direction.

As shown in FIG. 1, an inkjet printer 1 according to this embodiment includes a conveyer 2, an inkjet head 3, a head driver 4, and a controller 5.

The conveyer 2 is configured to convey the sheet PA. As shown in FIG. 2, the conveyer 2 includes a conveyer belt 11, a driven roller 12, and follower rollers 13 to 15.

The conveyer belt 11 is an annular belt fitted over the driven roller 12 and the follower rollers 13 to 15. The conveyer belt 11 has a number of belt holes to suck and hold the sheet PA by use of sucking force generated therein by a fan (not shown). The conveyer belt 11 is rotated clockwise in FIG. 2 by the driven roller 12 being driven, and thereby conveys the sheet PA, which is sucked and held thereon, rightward.

The conveyer belt 11 is fitted over the driven roller 12 and the follower rollers 13 to 15. The driven roller 12 rotates the conveyer belt 11 by being driven by a motor (not shown). The follower rollers 13 to 15 follow the rotation of the driven roller 12 via the conveyer belt 11. The follower roller 13 is placed at a position which is at substantially the same height as the driven roller 12 and spaced away from the driven roller 12 by a predetermined distance in the left-right direction. The follower rollers 14 and 15 are placed at substantially the same height as each other below the driven roller 12 and the follower roller 13 and spaced away from each other by a predetermined distance in the left-right direction.

The inkjet head 3 is configured to eject ink to the sheet PA conveyed by the conveyer 2 to print an image thereon. The inkjet head 3 is placed above the conveyer 2. The inkjet head 3 is a line inkjet head and has multiple head blocks 21A, 21B, and so on. In this embodiment, the inkjet head 3 has six head blocks 21A to 21F, as shown in FIG. 3.

The six head blocks 21A to 21F are arranged in a zigzag manner. Specifically, the head blocks 21A to 21F are arranged in a main scanning direction MSD (a second direction) substantially orthogonal to a sub scanning direction SSD which is the same as the conveyance direction of the sheet PA (a first direction) in such a manner that they are alternately displaced in position in the sub scanning direction SSD. More specifically, the head blocks 21A, 21C, and 21E are arranged downstream of the head blocks 21B, 21D, and 21F. The upstream head blocks 21B, 21D, and 21F correspond to a first head block, and the downstream head blocks 21A, 21C, and 21E correspond to a second head block.

The head blocks 21A to 21F are arranged in the main scanning direction MSD (the front-rear direction) in such a manner that adjacent ones partially overlap each other. Specifically, a region A where two head blocks 21 overlap each other is formed between the head blocks 21A and 21B, between the head blocks 21B and 21C, between the head blocks 21C and 21D, between the head blocks 21D and 21E, and between the head blocks 21E and 21F.

In this embodiment, when the head blocks 21A to 21F do not need to be distinguished from each other for example, they may be denoted only by reference numeral 21 without the following alphabet (A to F).

Each head block 21 has a unit of four head modules 22C, 22K, 22M, and 22Y assembled together. The head modules 22C, 22K, 22M, and 22Y are arranged in this order from the upstream side (left side). The head modules 22C, 22K, 22M, and 22Y are configured to eject ink of cyan (C), black (K), magenta (M), and yellow (Y), respectively. In this embodiment, when the head modules 22C, 22K, 22M, and 22Y do not need to be distinguished regarding their colors for example, they may be denoted without their following alphabets (C, K, M, and Y) indicating their colors.

As shown in FIG. 4, the head modules 22C, 22K, 22M, and 22Y have nozzle arrays 23C, 23K, 23M, and 23Y at their lower surfaces, respectively. FIG. 4 shows the head blocks 21A and 21B from below. The nozzle arrays 23C, 23K, 23M, and 23Y are each formed by multiple nozzles 24 configured to eject ink of a corresponding one of cyan (C), black (K), magenta (M), and yellow (Y). The nozzles 24 of each nozzle array 23 are arranged in the main scanning direction MSD at equal intervals of a predetermined pitch P.

Each head module 22 is arranged with the nozzles 24 thereof displaced in position from those of its adjacent head module 22 by a half pitch (P/2) in the main scanning direction MSD. Specifically, as shown in FIG. 4, the head modules 22K and 22Y are displaced rearward from the head modules 22C and 22M by a half pitch. The head module 22C and the head module 22M are arranged in such a manner that the nozzles 24 of the head module 22C and the nozzles 24 of the head module 22M are respectively located at substantially the same positions as each other in the main scanning direction MSD. Similarly, the head module 22K and the head module 22Y are arranged in such a manner that the nozzles 24 of the head module 22K and the nozzles 24 of the head module 22Y are respectively located at substantially the same positions as each other in the main scanning direction MSD.

In the region A, the nozzles 24 of the head module 22 for a certain color of the head block 21 and the nozzles 24 of the head module 22 for the same color of the adjacent head block 21 are located at substantially the same positions as each other in the main scanning direction. Specifically, in the region A, the nozzles 24 of the head module 22C of the head block 21A and the nozzles 24 of the head module 22C of the head block 21B are at substantially the same positions as each other in the main scanning direction MSD. The same is true for the head modules 22K, 22M, and 22Y.

A white line or the like is formed in a printed image when the distance between the nozzles 24 is larger than the pitch P at a joint portion of the head blocks 21. Thus, the region A is provided as above to prevent formation of such a white line. To prevent inks of the same color from being doubly ejected to the same position from two head blocks 21 in the region A during printing, the nozzles 24 used for ink ejection are determined for each head module 22 of each head block 21. This determination of the nozzles 24 used for ink ejection will be described later.

The head driver 4 is configured to drive the inkjet head 3. Specifically, the head driver 4 is configured to drive each head module 22 of each head block 21 so that ink may be ejected from its nozzles 24.

The controller 5 is configured to control the operation of each part of the inkjet printer 1. The controller 5 includes a CPU, a RAM, a ROM, a hard disk, and the like.

The controller 5 is configured to predetermine, for each head module 22 of each head block 21, an endmost nozzle in each region A. The endmost nozzle is the endmost nozzle 24 in the nozzle array 23 among its nozzles 24 used for ink ejection. The controller 5 determines the endmost nozzle in each region A for each nozzle array 23 so that inks of the same color may not be doubly ejected to the same position from two head blocks 21. In addition, the controller 5 determines the endmost nozzle in each region A for each nozzle array 23 so that the order in which inks of respective colors are superimposed may be the same for a portion in the region A and for a portion outside the region A. Specifically, for each of the upstream head blocks 21B, 21D, and 21F, the controller 5 determines the endmost nozzle in the region A of each nozzle array 23 so that the endmost nozzle of the nozzle array 23 located more downstream may be closer to the center of the head block 21 in the main scanning direction MSD. For each of the downstream head blocks 21A, 21C, and 21E, the controller 5 determines the endmost nozzle in the region A of each nozzle array 23 so that the endmost nozzle of the nozzle array 23 located more upstream may be closer to the center of the head block 21 in the main scanning direction MSD.

Next, the operation of the inkjet printer 1 is described.

The inkjet printer 1 predetermines the endmost nozzle in each region A for the nozzle array 23 in each head module 22 of each head block 21. A description is given of processing for determining the endmost nozzles in each region A.

Figure 5:
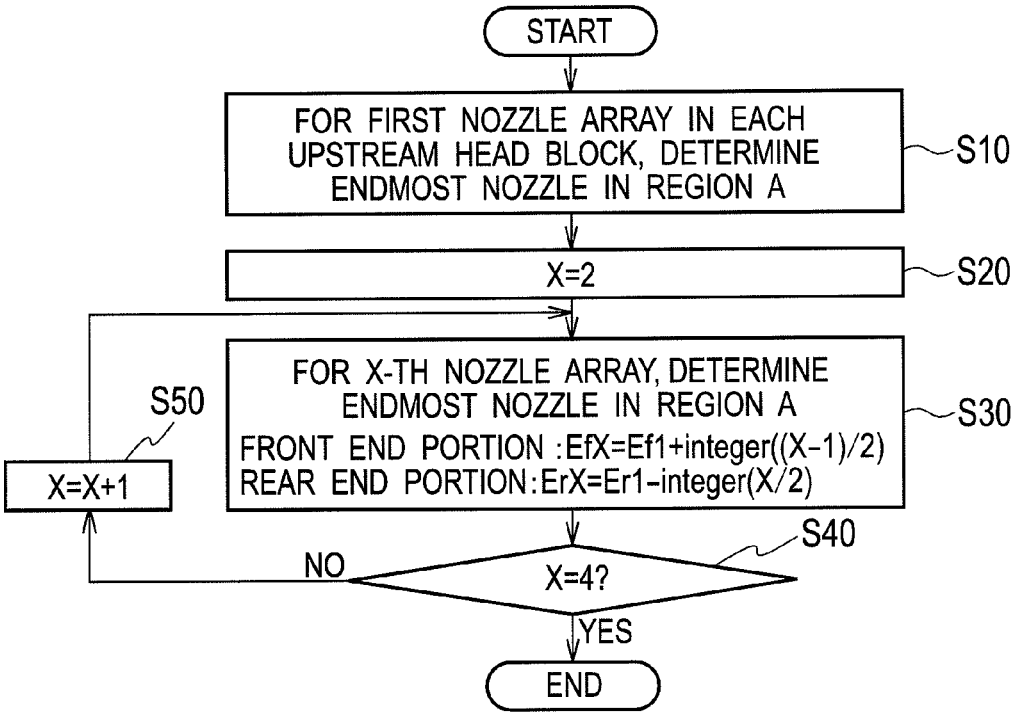
FIG. 5 is a flowchart of processing for determining, for each upstream head block, endmost nozzles in a region where the head block and its adjacent head block overlap.
Figure 6:
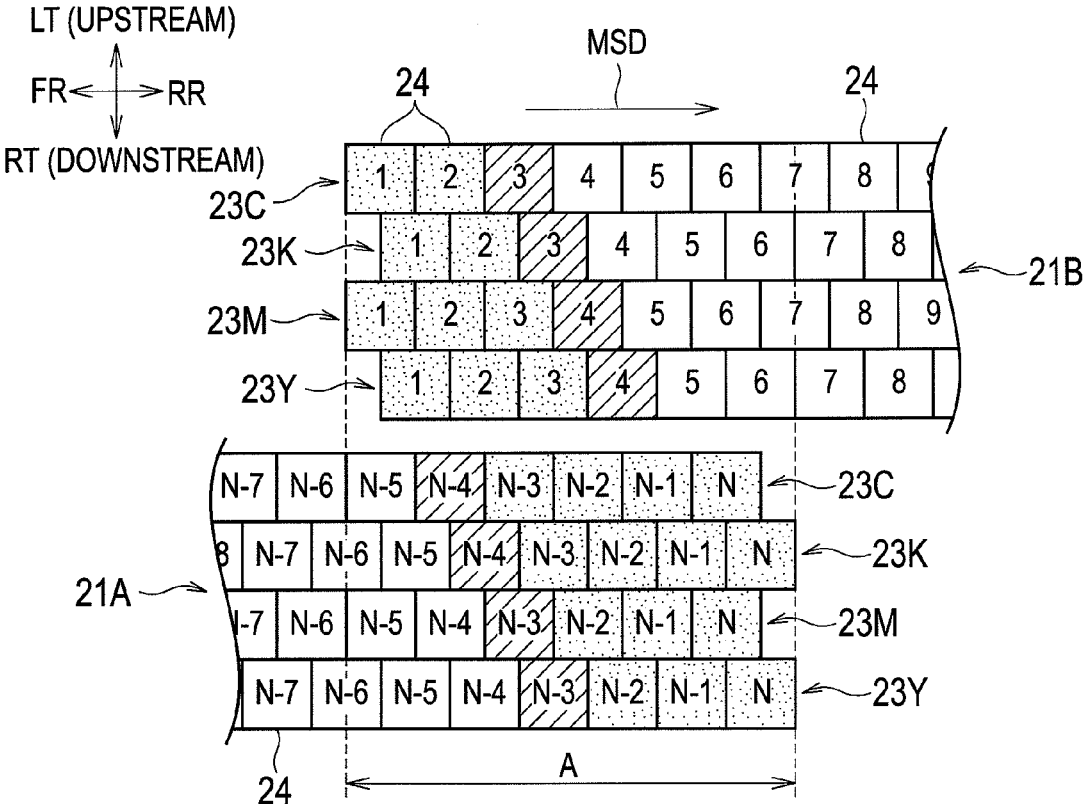
FIG. 6 is a schematic diagram illustrating the processing for determining the endmost nozzles in a region where the head block and its adjacent head block overlap.
Figure 7:
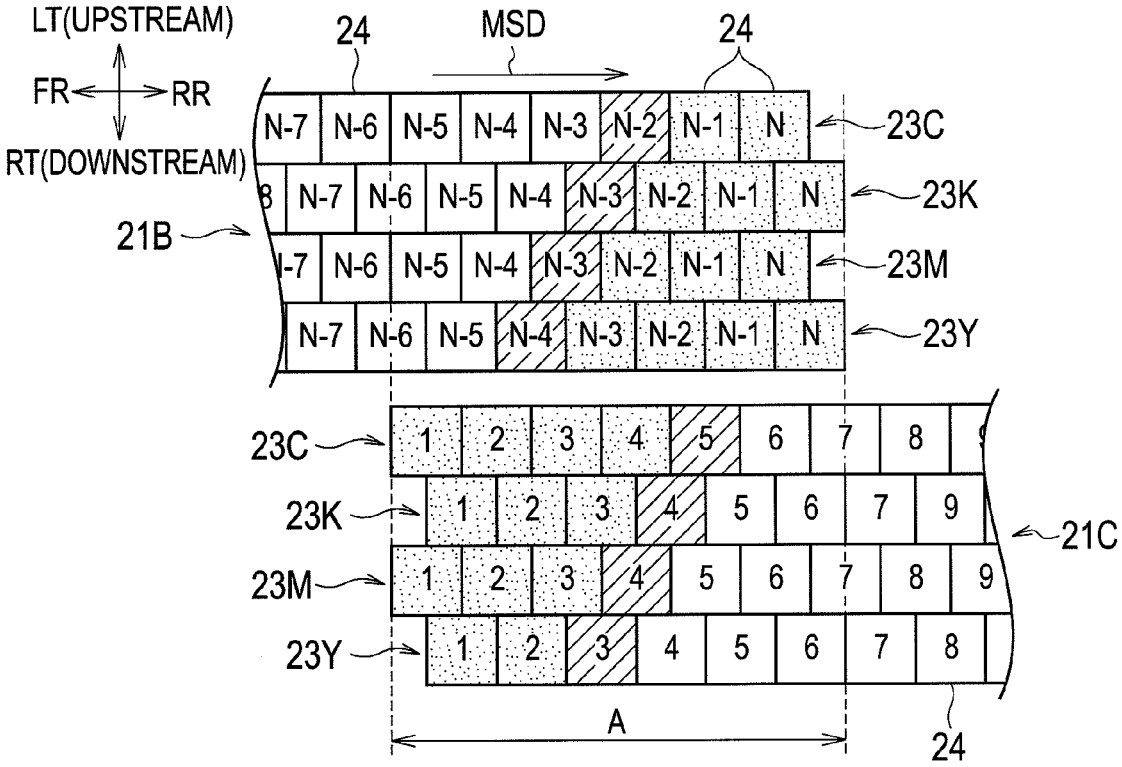
FIG. 7 is a schematic diagram illustrating the processing for determining the endmost nozzles in a region where the head block and its adjacent head block overlap.

First, the controller 5 determines the endmost nozzle in each region A for each of the upstream head blocks 21B, 21D, and 21F. FIG. 5 is a flowchart of the processing for determining the endmost nozzle in each region A for the upstream head blocks 21B, 21D, and 21F. FIGS. 6 and 7 are schematic diagrams illustrating the processing for determining the endmost nozzles in each region A for the upstream head blocks 21.

In Step S10 in FIG. 5, the controller 5 determines the endmost nozzle in each region A for each nozzle array 23C (the first array from the upstream side) in each upstream head block 21. For instance, as shown in FIG. 6, the controller 5 determines that the nozzle 24 of nozzle #3 marked with diagonal lines is an endmost nozzle of the nozzle array 23C in the region A located at a front end portion of the upstream head block 21B. Further, as shown in an example in FIG. 7, the controller 5 determines that the nozzle 24 of nozzle #(N−2) marked with diagonal lines is an endmost nozzle of the nozzle array 23C in the region A located at a rear end portion of the head block 21B.

Herein, as shown in FIGS. 6 and 7, the nozzles 24 of each nozzle array 23 are denoted by nozzle numbers 1, 2, . . . N, respectively, from the front side.

Next, in Step S20, the controller 5 sets "2" in variable X which corresponds to the array number of the nozzle array 23 to be processed.

Next, in Step S30, the controller 5 determines the endmost nozzle in each region A for the nozzle array 23 which is the X-th nozzle array from the upstream side. In determining the endmost nozzle in the region A at the front end portion of each upstream head block 21, the controller 5 determines a nozzle number EfX of the endmost nozzle according to Formula (1) given below. Further, in determining the endmost nozzle in the region A located at the rear end portion of each upstream head block 21, the controller 5 determines a nozzle number ErX of the endmost nozzle according to Formula (2) given below.

$$EfX = Ef1 + \text{integer}((X-1)/2) \quad \text{Formula (1)}$$

$$ErX = Er1 - \text{integer}(X/2) \quad \text{Formula (2)}$$

Ef1 in Formula (1) is the nozzle number of the front endmost nozzle of the first nozzle array determined in Step S10, and Er1 in Formula (2) is the nozzle number of the rear endmost nozzle of the first nozzle array determined in Step S10.

Next, in Step S40, the controller 5 determines whether or not the variable X is "4" which indicates that the target nozzle array 23 is the rearmost nozzle array 23 of the head block 21.

When determining that X=4 does not hold (Step S40: NO), the controller 5 adds "1" to the variable X in Step S50. Then, the controller 5 returns the processing to Step S30.

When determining that X=4 holds (Step S40: YES), the controller 5 ends the series of processing.

As shown in FIG. 6, if the nozzle 24 of nozzle #3 is determined as a front endmost nozzle of the nozzle array 23C (the first array from the upstream side) of the head block 21B, it is determined according to Formula (1) given above that a front endmost nozzle of the nozzle array 23K (the second array) is the nozzle 24 of nozzle #3 marked with diagonal lines. Similarly, a front endmost nozzle of the nozzle array 23M (the third array) and a front endmost nozzle of the nozzle array 23Y (the fourth array) are both the nozzle 24 of nozzle #4 marked with diagonal lines. In the head block 21B in FIG. 6, the nozzles 24 located frontward of the front endmost nozzles marked with diagonal lines (i.e., the nozzles 24 marked with dots) are not used for ejection.

Further, as shown in FIG. 7, if the nozzle 24 of nozzle #(N−2) is determined as a rear endmost nozzle of the nozzle array 23C (the first array) of the head block 21B, it is determined according to Formula (2) given above that a rear endmost nozzle of the nozzle array 23K (the second array) is the nozzle 24 of nozzle #(N−3) marked with diagonal lines. Similarly, a rear endmost nozzle of the nozzle array 23M (the third array) and a rear endmost nozzle of the nozzle array 23Y (the fourth array) are the nozzle 24 of nozzle #(N−3) and the nozzle 24 of nozzle #(N−4), respectively, both marked with diagonal lines. In the head block 21B in FIG. 7, the nozzles 24 located rearward of the rear endmost nozzles marked with diagonal lines (i.e., the nozzles 24 marked with dots) are not used for ejection.

By the processing described above with reference to the flowchart in FIG. 5, the controller 5 determines the endmost nozzle in each region A for each nozzle array 23 in each upstream head block 21 so that the endmost nozzle of the nozzle array 23 located more downstream may be closer to the center of the head block 21 in the main scanning direction MSD, as shown in FIGS. 6 and 7.

Figure 8:
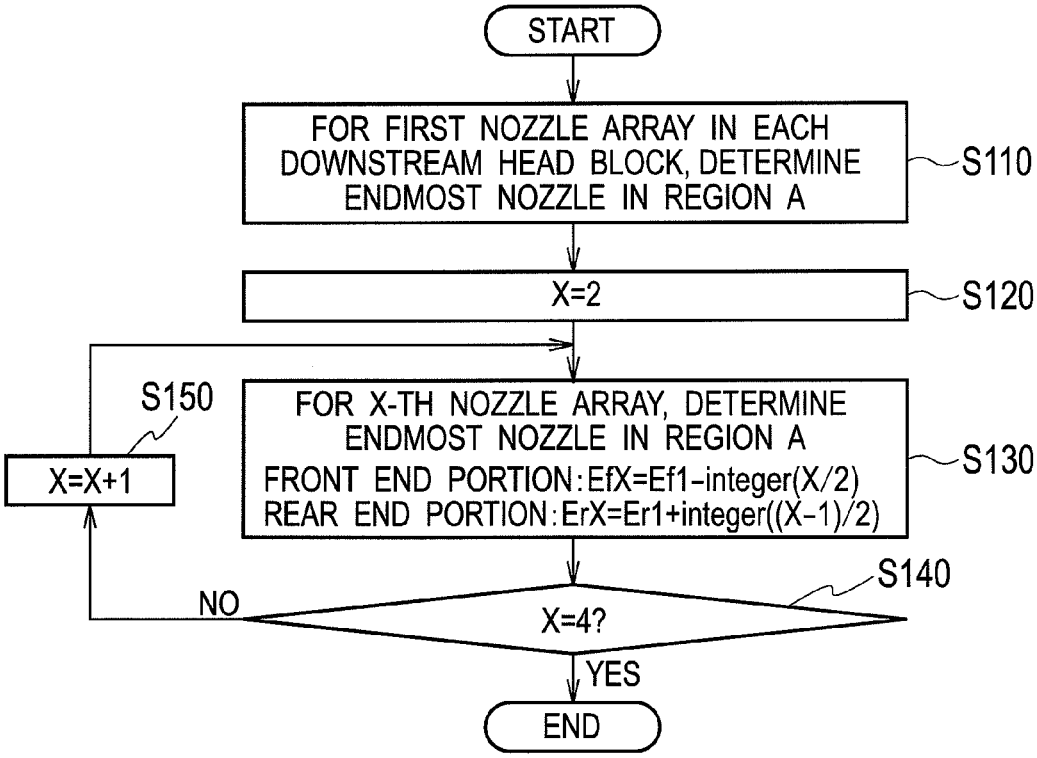
FIG. 8 is a flowchart of processing for determining, for each downstream head block, endmost nozzles in a region where the head block and its adjacent head block overlap.

Next, the controller 5 determines the endmost nozzle in each region A for each of the downstream head blocks 21A, 21C, and 21E. FIG. 8 is a flowchart of processing for determining the endmost nozzle in each region A for the downstream head blocks 21A, 21C, and 21E.

In Step S110 in FIG. 8, the controller 5 determines the endmost nozzle in each region A for the nozzle array 23C (the first array from the upstream side) in each downstream head block 21. In this step, the controller 5 determines that the endmost nozzle of the nozzle array 23C in the region A located at a rear end portion of the downstream head block 21 is the nozzle 24 adjacently frontward of the front endmost nozzle of the nozzle array 23C of its upstream head block 21. Further, the controller 5 determines that the endmost nozzle of the nozzle array 23C in the region A located at a front end portion of the downstream head block 21 is the nozzle 24 adjacently rearward of the rear endmost nozzle of the nozzle array 23C of its upstream head block 21.

For instance, in FIG. 6, the front endmost nozzle of the nozzle array 23C of the upstream head block 21B is the nozzle 24 of nozzle #3. Then, in the nozzle array 23C of the downstream head block 21A, the nozzle 24 of nozzle #(N−4) marked with diagonal lines is the nozzle located at a position adjacently frontward of the nozzle 24 of nozzle #3 of the nozzle array 23C of the upstream head block 21B. Hence, the controller 5 determines that this nozzle 24 of nozzle #(N−4) is the rear endmost nozzle of the nozzle array 23C of the head block 21A.

Further, in the example in FIG. 7, the controller 5 determines that the front endmost nozzle of the nozzle array 23C (the first array) of the downstream head block 21C is the nozzle 24 of nozzle #5 marked with diagonal lines. This nozzle 24 of nozzle #5 is located at a position adjacently rearward of the nozzle 24 of nozzle #(N−2) which is the rear endmost nozzle of the nozzle array 23C in the upstream head block 21B.

Next, in Step S120, the controller 5 sets "2" in variable X which corresponds to the array number of the nozzle array 23 to be processed.

Next, in Step S130, the controller 5 determines the endmost nozzle in each region A for the nozzle array 23 which is the X-th array from the upstream side. In determining the endmost nozzle in the region A located at the front end portion of each downstream head block 21, the controller 5 determines a nozzle number EfX of the endmost nozzle according to Formula (3) given below. Further, in determining the endmost nozzle in the region A at the rear end portion of each downstream head block 21, the controller 5 determines a nozzle number ErX of the endmost nozzle according to Formula (4) given below.

$$EfX=Ef1-\text{integer}(X/2) \quad \text{Formula (3)}$$

$$ErX=Er1+\text{integer}((X-1)/2) \quad \text{Formula (4)}$$

Ef1 in Formula (3) is the nozzle number of the front endmost nozzle of the first nozzle array determined in Step S110, and Er1 in Formula (4) is the nozzle number of the rear endmost nozzle of the first nozzle array determined in Step S110.

Next, in Step S140, the controller 5 determines whether or not the variable X is "4" which indicates that the target nozzle array 23 is the rearmost nozzle array 23.

When determining that X=4 does not hold (Step S140: NO), the controller 5 adds "1" to the variable X in Step S150. Then, the controller 5 returns the processing to Step S130.

When determining that X=4 holds (Step S140: YES), the controller 5 ends the series of processing.

As shown in FIG. 6, if the nozzle 24 of nozzle #(N−4) is determined as a rear endmost nozzle of the nozzle array 23C (the first array) of the head block 21A, it is determined according to Formula (4) given above that a rear endmost nozzle of the nozzle array 23K (the second array) is the nozzle 24 of nozzle #(N−4) marked with diagonal lines. Similarly, a rear endmost nozzle of the nozzle array 23M (the third array) and a rear endmost nozzle of the nozzle array 23Y (the fourth array) are both the nozzle 24 of nozzle #(N−3) marked with diagonal lines. In the head block 21A in FIG. 6, the nozzles 24 located rearward of the rear endmost nozzles marked with diagonal lines (i.e., the nozzles 24 marked with dots) are not used for ejection.

Further, as shown in FIG. 7, if the nozzle 24 of nozzle #5 is determined as a front endmost nozzle of the nozzle array 23C (the first array) of the head block 21C, it is determined according to Formula (3) given above that a front endmost nozzle of the nozzle array 23K (the second array) is the nozzle 24 of nozzle #4 marked with diagonal lines. Similarly, a front endmost nozzle of the nozzle array 23M (the third array) and a front endmost nozzle of the nozzle array 23Y (the fourth array) are the nozzle 24 of nozzle #4 and the nozzle 24 of nozzle #3, respectively, both marked with diagonal lines. In the head block 21C in FIG. 7, the nozzles 24 located frontward of the front endmost nozzles marked with diagonal lines (i.e., the nozzles 24 marked with dots) are not used for ejection.

By the processing described above with reference to the flowchart in FIG. 8, as shown in FIG. 6, the controller 5 determines, for each downstream head block 21, that the endmost nozzle of the nozzle array 23 for a certain color in the region A located at a rear end portion of the downstream head block 21 is the nozzle 24 adjacently frontward of the front endmost nozzle of the nozzle array 23 for the same color in its upstream head block 21. Further, as shown in FIG. 7, the controller 5 determines, for each downstream head block 21, that the endmost nozzle of the nozzle array 23 for a certain color in the region A located at a front end portion of the downstream head block 21 is the nozzle 24 adjacently rearward of the rear endmost nozzle of the nozzle array 23C for the same color in its upstream head block 21.

Thereby, even at a joint portion of the upstream head block 21 and the downstream head block 21, the ejection interval in the main scanning direction is the same as that in other portions.

As a result, as shown in FIGS. 6 and 7, the endmost nozzle in each region A for each nozzle array 23 in the downstream head block 21 is determined so that the endmost nozzle of the nozzle array 23 located more upstream may be closer to the center of the head block 21 in the main scanning direction MSD.

As described above, in each head block 21 of the inkjet printer 1, the head modules 22K and 22Y are displaced rearward from the head modules 22C and 22M by the half pitch (P/2). Contrary to this, the inkjet printer 1 may use the head block 21 in which the head modules 22K and 22Y are displaced frontward from the head modules 22C and 22M by the half pitch. This type of head block 21 is called a reversely-displaced head block 21 below.

Even when the reversely-displaced head blocks 21 are used, the controller 5 determines the endmost nozzle in each region A for each nozzle array 23 in each upstream head block 21 by performing the same processing as that described above with reference to the flowchart in FIG. 5. Further, the controller 5 determines the endmost nozzle in each region A for each nozzle array 23 in each downstream head block 21 by performing the same processing as that described above with reference to the flowchart in FIG. 8.

Note, however, that when the reversely-displaced head blocks 21 are used, in Step S30 in FIG. 5 the controller 5 uses Formula (5) and Formula (6) given below instead of Formula (1) and Formula (2).

$$EfX=Eff1+\text{integer}(X/2) \quad \text{Formula (5)}$$

$$ErX=Er1-\text{integer}((X-1)/2) \quad \text{Formula (6)}$$

Moreover, in Step S130 in FIG. 8, the controller 5 uses Formula (7) and Formula (8) given below instead of Formula (3) and Formula (4)

$$EfX=Ef1-\text{integer}((X-1)/2) \quad \text{Formula (7)}$$

$$ErX=Er1+\text{integer}(X/2) \quad \text{Formula (8)}$$

Figure 9:
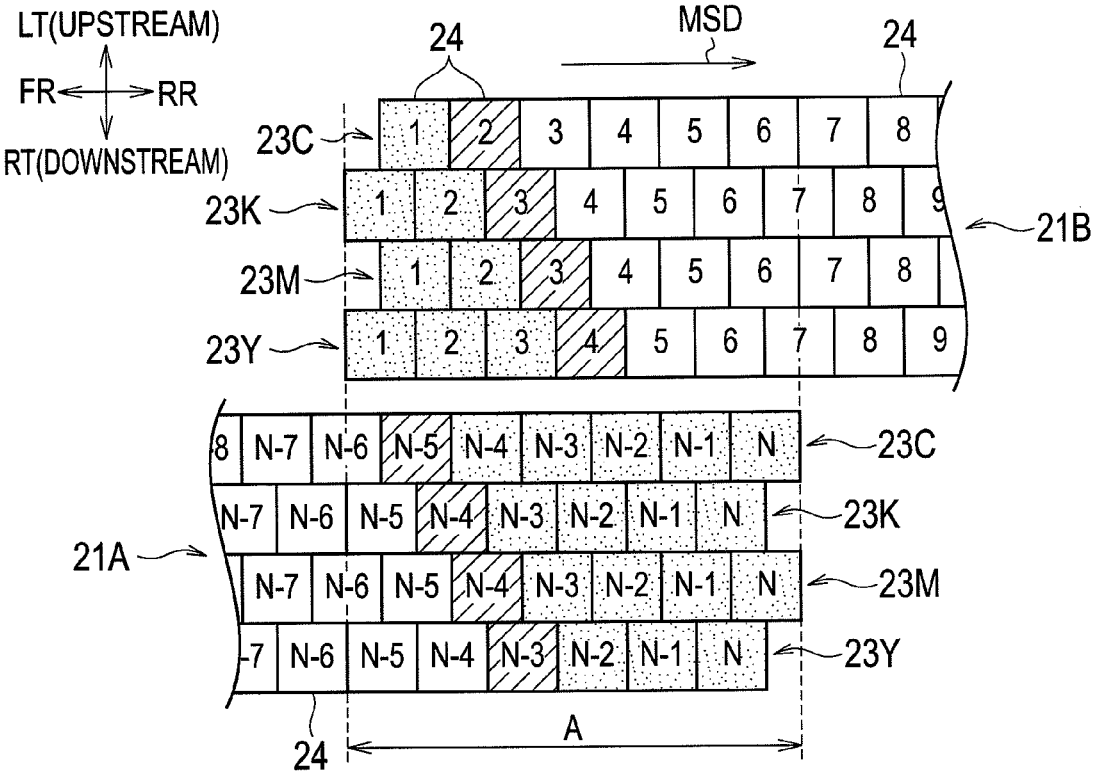
FIG. 9 is a schematic diagram showing endmost nozzles in an overlapping portion of reversely-displaced head blocks.
Figure 10:
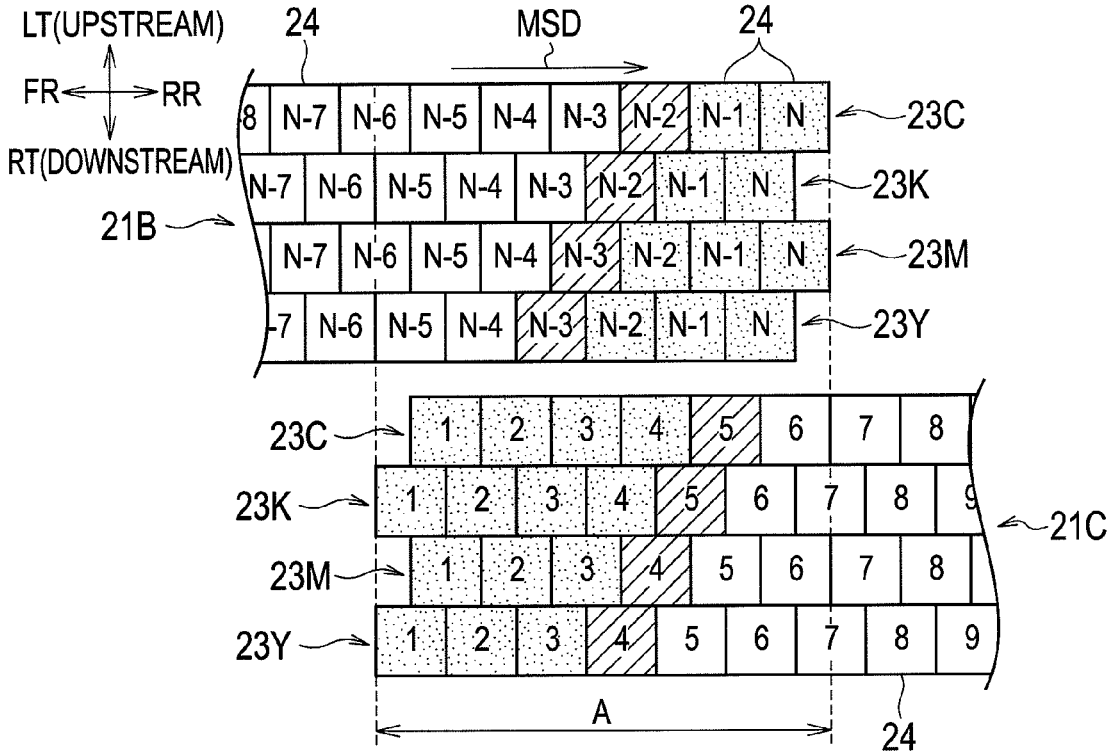
FIG. 10 is a schematic diagram showing endmost nozzles in an overlapping portion of reversely-displaced head blocks.

Thereby, even when the reversely-displaced head blocks 21 are used, the controller 5 can determine the endmost nozzle in each region A for each nozzle array 23 in each upstream head block 21 so that, as shown in FIGS. 9 and 10 for example, the endmost nozzle of the nozzle array 23 located more downstream may be closer to the center of the head block 21 in the main scanning direction MSD. Moreover, the controller 5 can determine the endmost nozzle in each region A for each nozzle array 23 in each downstream head block 21 so that, as shown in FIGS. 9 and 10 for example, the endmost nozzle of the nozzle array 23 located more upstream may be closer to the center of the head block 21 in the main scanning direction MSD.

Next, a printing operation of the inkjet printer 1 is described.

When image data to be printed is inputted, the controller 5 determines, based on the image data, timings to eject ink from the nozzles 24 of each head block 21. In this determination, the controller 5 determines the nozzles 24 to be used for ink ejection according to the positions of the endmost nozzles in each nozzle array 23 of each head block 21 predetermined as described above.

The controller 5 also drives the conveyer 2. The conveyer 2 conveys the sheet PA fed by a feeder (not shown). The controller 5 instructs the head driver 4 to drive each head module 22 of each head block 21 so that ink will be ejected at the ejection timings determined based on the image data. An image is thus printed on the sheet PA.

As described above, the controller 5 determines the endmost nozzle in each region A for each nozzle array 23 in each of the upstream head blocks 21B, 21D, and 21F so that the endmost nozzle of the nozzle array 23 located more downstream may be closer to the center of the head block 21 in the main scanning direction MSD. Then, in accordance with this, the controller 5 determines the endmost nozzle in each region A for each nozzle array 23 in each of the downstream head blocks 21A, 21C, and 21E so that the endmost nozzle of the nozzle array 23 located more upstream may be closer to the center of the head block 21 in the main scanning direction MSD.

Figure 11:
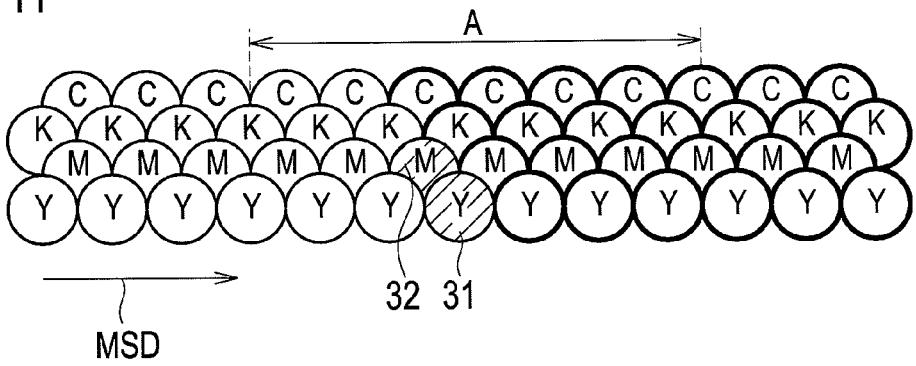
FIG. 11 is a diagram showing how inks of respective colors are superimposed in and around the region where the head blocks overlap each other, by printing performed according to the embodiment.

Thereby, during printing, inks of respective colors are superimposed in the same order in the entire region A and in a portion outside the region A. For example, inks of different colors ejected from the head block 21A and inks of different colors ejected from the head block 21B are superimposed on one another as shown in FIG. 11. In FIG. 11, thick-line circles indicate ink dots shot by the upstream head block 21B, and thin-line circles indicate ink dots shot by the downstream head block 21A. C, K, M, or Y in each circle indicates the color of the dot. In FIG. 11, the dot arrays of the respective colors are displaced vertically for illustration purpose, but they are actually shot on the same line. In FIG. 11, ink of cyan (C), black (K), magenta (M), and yellow (Y) are shot in this order in the entire region A like in a portion outside the region A. Thus, the same color as that printed in the portion outside the region A is printed in the region A.

Figure 12:
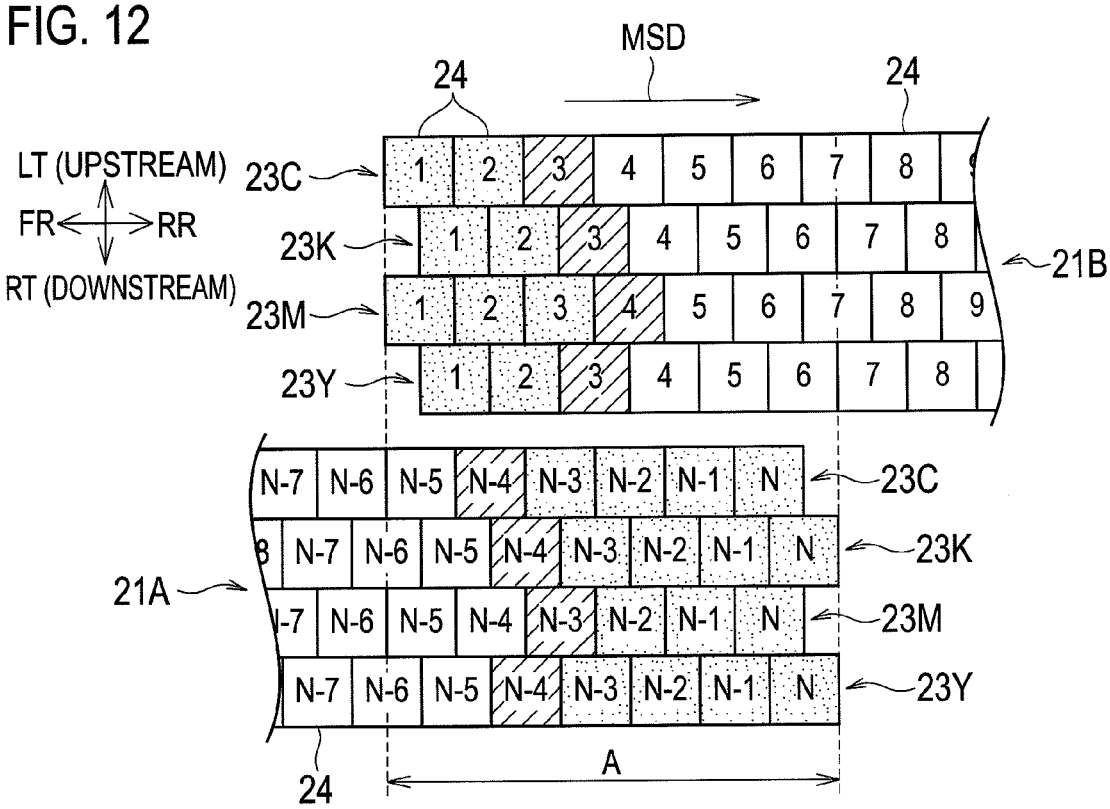
FIG. 12 is a schematic diagram showing endmost nozzles determined at different positions from those in the embodiment.

For example, assume that the endmost nozzles of each nozzle array 23 are determined as shown in FIG. 12. Then, unlike the example in FIG. 6, inks of the respective colors ejected by the head block 21A and inks of the respective colors ejected by the head block 21B are superimposed on one another as shown in FIG. 13.

In FIG. 12, the endmost nozzle in the region A for the nozzle array 23Y in the upstream head block 21B is the nozzle 24 of nozzle #3. This nozzle 24 of nozzle number 3 of the nozzle array 23Y is located outward (frontward) of the nozzle 24 of nozzle #4 (the endmost nozzle) of the nozzle array 23M adjacent to the nozzle array 23Y to the upstream side. In accordance with this, in FIG. 12, the endmost nozzle in the region A for the nozzle array 23Y in the downstream head block 21A is the nozzle 24 of nozzle #(N−4). This nozzle 24 of nozzle number (N−4) of the nozzle array 23Y is located outward (frontward) of the nozzle 24 of nozzle #(N−3) (the endmost nozzle) of the nozzle array 23M adjacent to the nozzle array 23Y to the upstream side.

Figure 13:
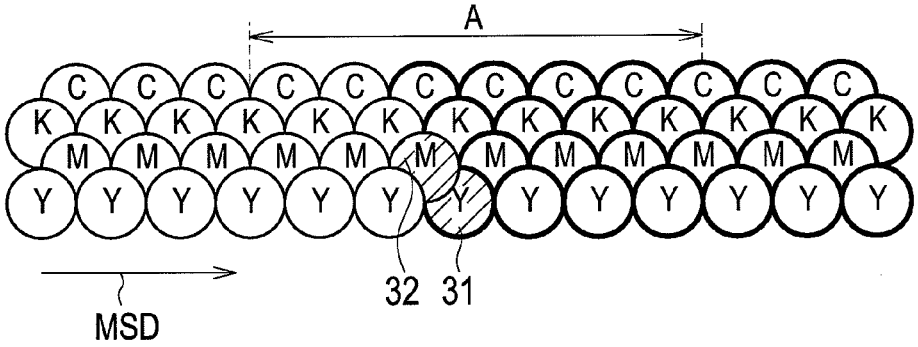
FIG. 13 is a diagram showing how inks of respective colors are superimposed in and around the region where the head blocks overlap each other, by printing performed in a case where the endmost nozzles are determined as shown in FIG. 12.

If the endmost nozzles are determined as shown in FIG. 12, as shown in FIG. 13, a yellow (Y) dot 31 is shot from the nozzle 24 of nozzle #3 of the nozzle array 23C in the head block 21B, and thereafter, a magenta (M) dot 32 is shot from the nozzle 24 of nozzle #(N−3) of the nozzle array 23Y of the head block 21A. Thus, the magenta (M) dot 32 is superimposed on the yellow (Y) dot 31. In other portions, yellow (Y) dots are superimposed on magenta (M) dots. For this reason, in this portion where the magenta (M) dot 32 is superimposed on the yellow (Y) dot 31, the color tone is different from the other portions.

In this way, depending on the positions of the endmost nozzles, or in other words, depending on the selection of the nozzles 24 used for ink ejection, the order of superimposing inks of respective colors is different at a certain portion from that in the other portions. As a result, a printed image includes a portion having a different color tone from its surrounding portion, as described above, which consequently lowers the quality of the printed image.

In contrast, if the endmost nozzles are determined as shown in FIG. 6, the magenta (M) dot 32 is shot from the nozzle 24 of nozzle #(N−3) of the nozzle array 23M of the head block 21A, and thereafter, the yellow (Y) dot 31 is shot from the nozzle 24 of nozzle #(N−3) of the nozzle array 23Y of the head block 21A. Thus, the yellow (Y) dot is superimposed on the magenta (M) dot in this portion, as well as in the other portions. Consequently, the color tone does not change in the region A as in the example shown in FIGS. 12 and 13.

In this embodiment, since the order of superimposing the inks of respective colors is the same in the entire region A and in the portion outside the region A, lowering of the quality of a printed image can be suppressed.

Although the head block 21 in this embodiment has four nozzle arrays 23, the present invention is applicable as long as the head block 21 has multiple nozzle arrays 23.

In this embodiment, each nozzle array 23 is displaced from its adjacent nozzle array 23 by a half pitch (P/2) in the main scanning direction. However, the length of displacement of the nozzle arrays 23 is not limited to the half pitch.

Although the inkjet printer 1 of this embodiment has the line inkjet head 3, the present invention is applicable to an inkjet printer having a serial inkjet head 3.

If the serial inkjet head 3 is used, the inkjet head 3 is configured to be capable of reciprocating in the left and right directions in FIGS. 2 and 3 by a driver including a motor and the like. The inkjet head 3 ejects ink while moving in the left and right directions above a sheet and thus prints on the sheet.

When the serial inkjet head 3 is used, a front in its moving direction during printing corresponds to the upstream of the case where the line inkjet head 3 is used, and a rear in the moving direction corresponds to the downstream of the case where the line inkjet head 3 is used.

When the inkjet head 3 is moving to the left, the head blocks 21B, 21D, and 21F are the front head blocks, and the head blocks 21A, 21C, and 21E are the rear head blocks. Thus, in this case, the head blocks 21B, 21D, and 21F correspond to the upstream head blocks of the case where the line inkjet head 3 is used, and the head blocks 21A, 21C, and 21E correspond to the downstream head blocks of the case where the line inkjet head 3 is used.

Thus, in this case, the endmost nozzle in each region A is determined for each nozzle array 23 in each of the front (left) head blocks 21B, 21D, and 21F so that the endmost nozzle of the nozzle array 23 located more rearward (rightward) may be closer to the center of the head block 21 in the main scanning direction MSD. Moreover, the endmost nozzle in each region A is determined for each nozzle array 23 in each of the rear (right) head blocks 21A, 21C, and 21E so that the endmost nozzle of the nozzle array 23 located more frontward (leftward) may be closer to the center of the head block 21 in the main scanning direction MSD.

When the inkjet head 3 is moving to the right, on the other hand, the head blocks 21A, 21C, and 21E are the front head blocks, and the head blocks 21B, 21D, and 21F are the rear head blocks. Thus, in this case, the head blocks 21A, 21C, and 21E correspond to the upstream head blocks of the case where the line inkjet head 3 is used, and the head blocks 21B, 21D, and 21F correspond to the downstream head blocks of the case where the line inkjet head 3 is used.

Thus, in this case, the endmost nozzle in each region A is determined for each nozzle array 23 in each of the front (right) head blocks 21A, 21C, and 21E so that the endmost nozzle of the nozzle array 23 located more rearward (leftward) may be closer to the center of the head block 21 in the main scanning direction MSD. Moreover, the endmost nozzle in each region A is determined for each nozzle array 23 in each of the rear (left) head blocks 21B, 21D, and 21F so that the endmost nozzle of the nozzle array 23 located more frontward (rightward) may be closer to the center of the head block 21 in the main scanning direction MSD.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

an inkjet head having a first head block and a second head block and configured to eject ink to a print medium being conveyed in a conveyance direction; and a controller configured to control the inkjet head, wherein the second head block is arranged downstream of the first head block in a first direction being the conveyance direction, the first head block and the second head block are displaced from each other to partially overlap one another in portions frontward of the first head block and rearward of the second head block in a second direction orthogonal to the first direction, the first head block includes a first array having a plurality of first nozzles arranged in the second direction, and a second array located upstream of the first array in the first direction and having a plurality of second nozzles arranged in the second direction and displayed from the plurality of first nozzles in the second direction, the second head block includes a third array having a plurality of third nozzles arranged in the second direction, and a fourth array located downstream of the third array in the first direction and having a plurality of fourth nozzles arranged in the second direction and displaced from the plurality of third nozzles in the second direction, the plurality of first nozzles and the plurality of third nozzles are configured to eject inks of a first color, the plurality of second nozzles and the plurality of fourth nozzles are configured to eject inks of a second color different from the first color, the controller is configured to determine a first endmost nozzle to be used for ejection from the plurality of first nozzles of the first nozzle array in a first region of the first head block overlapping the second head block, determine a second endmost nozzle to be used for the ejection from the plurality of second nozzles of the second nozzle array in the first region, the first endmost nozzle being closer to a center of the first head block in the second direction than the second endmost nozzle, prevent ink from being ejected by nozzles frontward of the first endmost nozzle in the second direction among the plurality of first nozzles of the first nozzle array, and prevent ink from being ejected by nozzles frontward of the second endmost nozzle in the second direction among the plurality of second nozzles of the second nozzle array, determine a third endmost nozzle to be used for ejection from the plurality of third nozzles of the third nozzle array in a second region of the second head block overlapping the first head block, determine a fourth endmost nozzle to be used for the ejection from the plurality of fourth nozzles of the fourth nozzle array in the second region, the third endmost nozzle being closer to a center of the second head block in the second direction than the fourth endmost nozzle, prevent ink from being ejected by nozzles rearward of the third endmost nozzle in the second direction among the plurality of third nozzles of the third nozzle array, and prevent ink from being ejected by nozzles rearward of the fourth endmost nozzle in the second direction among the plurality of fourth nozzles of the fourth nozzle array.

* * * * *